US005675915A

United States Patent [19]

Faughn et al.

[11] Patent Number: 5,675,915

[45] Date of Patent: Oct. 14, 1997

[54] IMPACT ABSORBING SOLES FOR PARACHUTISTS

[75] Inventors: Jim Faughn, Bel Air; Harrison P. Crowell, III, Forest Hill, both of Md.

[73] Assignee: The United States of America as represented by the Secretary of the Army, Washington, D.C.

[21] Appl. No.: 673,892

[22] Filed: Jul. 1, 1996

Related U.S. Application Data

[63] Continuation of Ser. No. 408,258, Mar. 21, 1995, abandoned.

[51] Int. Cl.[6] ..... A43B 3/10; A43B 3/00

[52] U.S. Cl. ..... 36/7.5; 36/1; 36/114; 36/136; 36/132; 36/7.1 R; 36/113; 36/7.8

[58] Field of Search ..... 36/1, 88, 114, 36/115, 132, 136, 7.1 R, 7.3, 7.5, 7.8, 15, 28, 113

[56] References Cited

U.S. PATENT DOCUMENTS

| | | | |
|---|---|---|---|
| 221,855 | 11/1879 | Oppenheimer . | |
| 2,469,969 | 5/1949 | Lee | 36/7.8 |
| 2,519,458 | 8/1950 | Hall | 36/7.5 |
| 2,720,714 | 10/1955 | Krohn et al. | 36/7.5 |
| 2,932,910 | 4/1960 | Brown | 36/7.5 X |
| 2,968,105 | 1/1961 | Rizzo | 36/7.8 |
| 3,538,628 | 11/1970 | Einstein, Jr. | 36/15 |
| 3,733,721 | 5/1973 | Clemens | 36/7.5 |
| 4,128,950 | 12/1978 | Bowerman et al. | 36/30 R |
| 4,316,332 | 2/1982 | Giese et al. | 36/28 |
| 4,627,179 | 12/1986 | McElroy | 36/44 |
| 4,874,640 | 10/1989 | Donzis | 36/37 X |
| 4,890,397 | 1/1990 | Harada et al. | 36/114 X |
| 5,383,920 | 1/1995 | Sikes | 607/112 |

*Primary Examiner*—M. D. Patterson

*Attorney, Agent, or Firm*—Freda L. Krosnick; Paul S. Clohan

[57] ABSTRACT

An impact absorbing device for parachutists is disclosed. A conventional overshoe may be modified by riveting or otherwise fastening hook and loop material to the bottom of the overshoe. An impact absorbing sole having a top surface including hook and loop material may be quickly attached to and detached from the modified overshoe. It is also contemplated to provide fastening straps in lieu of or in addition to the hook and loop fastener. The fastening straps may encircle the forefoot area and/or the heel and ankle. The sole may have three layers of solid material or the middle layer may include apertures, which correspond to the heel and ball areas of the foot, for receiving cushioning inserts. The layers may be made of a high density open cell urethane foam, a microcellular ethylene vinyl acetate (EVA) polyethylene foam, a viscoelastic plasticized polyurethane polymer, or a viscoelastic urethane rubber polymer. The layers may be laminated together using any conventional adhesive.

14 Claims, 18 Drawing Sheets

MAXIMUM MOMENT ABOUT THE VERTICAL AXIS BY LEGWEAR

MAXIMUM HORIZONTAL IMPACT FORCE BY LEGWEAR

PERCENT CHANGES IN MAXIMUM VERTICAL IMPACT VERSUS LEGWEAR BY JUMP HEIGHT

| IMPACT ABSORBING SOLES | | | | |
|---|---|---|---|---|
| | PORON | EVA | SORBOTHANE WITH (PORON) | AKTON WITH (PORON) |
| MATERIAL TYPE | HIGH DENSITY OPEN CELL URETHANE FOAM | MICROCELLULAR EVA CLOSED CELL FOAM | VISCOELASTIC PLASTICIZED POLYURETHANE POLYMER | VISCOELASTIC URETHANE RUBBER POLYMER |
| HARDNESS | SHORE "0" 18 | SHORE "A" 25–30 | SHORE "00" 30 | SHORE "000" 45 |
| WEIGHT OF SOLES PER PAIR | 0.86 KG (1.89 LB) | 0.51 KG (1.12 LB) | 1.21 KG (2.66 LB) | 1.14 KG (2.51 LB) |
| OPTIMUM TEMPERATURE PERFORMANCE RANGE | −40 – 70 C (−40 – 153 F) | −57 – 71 C (−70 – 160 F) | −40 – 93 C (−40 – 200 F) | −94 – 104 C (−65 – 220 F) |

MATERIAL PROPERTIES

FIGURE 18

IMPACT ABSORBING SOLES FOR PARACHUTISTS

This application is a continuation of application Ser. No. 08/408,258, filed Mar. 21, 1995, now abandoned.

BACKGROUND OF INVENTION

1. Field of the Invention

This invention relates to devices for absorbing impact forces experienced by military parachutists. More particularly, the present invention relates to an impact-absorbing device including overshoes worn over the boots of a parachutist and exterior, lightweight, collapsible impact-absorbing soles, which may be attached to the bottoms of the overshoes so a parachutist or jumper is subjected to minimized impact forces upon landing.

2. Description of the Prior Art

When conducting a rapid deployment mission, a military parachutist typically wears government-issue combat jump boots or a commercially available variation of the jump boot allowed by their commander. Some parachutists have modified the sole of their boots by having a wedge of ethylene vinyl acetate (EVA) or similar foam, material, etc., sewn or laminated into the heel and forefoot section of their boots to add cushioning.

It has been estimated that 1% to 6% of a rapidly deployed unit may be injured during parachute landing. In the event of a small number of deployed troops, the loss of very few troops may seriously degrade the ability of the unit to accomplish its mission. There exists a need to minimize injuries due to parachute landing without unduly adding to the equipment carried by a military parachutist.

U.S. Pat. No. 221,855 issued on Nov. 18, 1879 for a parachute fire-escape device includes a parachute worn by a user and overshoes having elastic bottom pads to take up concussion with the ground. This patent does not describe an overshoe and detachable exterior cushioning sole combination having specific materials designed to minimize impact forces.

In parachuting, most injuries occur during landing (Ciccone & Richman, 1948; Essex-Lopresti, 1946; Hallel & Naggan, 1975; Kirby, 1974; Neel, 1951). Most of the injuries involve the lower extremities. The authors report lower extremity injuries account for 32% to 86% of parachuting injuries. Of the lower extremity injuries, 32% to 75% are ankle injuries, depending upon the study cited. Injuries to other parts of the body are reported at 4% to 39% for the pelvis and spine, 3% to 17% for the upper extremities, and 0% to 21% for the head and neck, again, depending upon the study cited.

The mechanisms for various parachuting injuries are presented by Ciccone and Richman (1948), Essex-Lopresti (1946), and Neel (1951). Mechanisms causing the most common injuries are summarized by Ciccone and Richman's four classifications: (1) torsion plus landing thrust, (2) backward landing, (3) opening shock, and (4) violent vertical landing. Torsion plus landing thrust is the most common lower extremity injury mechanism. It is the result of vertical and horizontal impact forces combined with torsional stresses which can cause numerous injuries such as ankle sprains and leg fractures.

In a backward landing, the paratrooper's buttocks and head impact the ground. This can cause compression fractures of the vertebrae and head injuries. (Although not mentioned by Ciccone and Richman, another common landing which can cause head injuries is the toes-knees-nose landing.) The opening shock mechanism includes whip lash and suspension line entanglements that occur as the parachute opens. When upper or lower extremities become entangled in the suspension lines, ligaments and muscles can be ruptured or stripped from the bone, and bones can be broken.

Violent vertical landings, the fourth injury mechanism, result from excessive vertical impact forces. Multiple fractures of the leg and spine are common for this injury mechanism.

There are many factors which affect the injury rate for parachuting. The main factor appears to be poor technique by the parachutist (Essex-Lopresti, 1946; Neel, 1951). Other factors are parachute descent rate, wind speed, landing terrain, darkness, and the parachutist's weight. The injury rate is higher for parachutes with a faster descent rate (Pirson & Verbiest, 1985). As wind speed increases, the injury rate increases (Essex-Lopresti, 1946; Pirson & Verbiest, 1985). The injury rate for landings on rough terrain is higher than the injury rate for landings on sand dunes (Hallel & Naggan, 1975). Night jumps have a higher injury rate than day jumps (Hallel & Naggan, 1975; Pirson & Verbiest, 1985). The injury rate is higher for heavy parachutists than for light parachutists (Essex-Lopresti, 1946; Pirson & Pirlot, 1990).

Most of the previous studies on landings have been done with gymnasts and recreational athletes. These studies report maximum vertical and horizontal impact forces for a variety of conditions. Ozguven and Berme (1988) measured the impact forces of gymnasts when they landed after dismounting the horizontal bar. The maximum vertical force they recorded ranged from 8.2 to 11.6 times body weight.

A study by McNitt-Gray (1991) examined vertical and horizontal impact forces for jumps from 0.32 m (1.05 ft.), 0.72 m (2.36 ft.), and 1.28 m (4.20 ft.). The average maximum vertical impact forces for gymnasts were 3.93, 6.26, and 10.96 times body weight for jumps from the lowest to highest heights. For the recreational athletes, the average maximum vertical impact forces were 4.16, 6.38, and 9.12 times body weight for jumps from the lowest to highest heights. The maximum horizontal impact forces were approximately 0.5, 1.0, and 2.0 times body weight for jumps from the lowest to highest heights.

Mizrahi and Susak (1982) had subjects drop from 1 m, land on the balls of their feet, and then naturally absorb the impact. For these landings, the maximum vertical force ranged from 6.6 to 10 times body weight. When the subjects landed flat footed and rolled to absorb the impact, the maximum vertical forces were 6.1 to 9 times body weight.

The study by Dufek and Bates (1990) examined maximum vertical forces for a combination of conditions: jump height, jump distance, and technique. They found vertical forces generally increased with increasing jump height and knee stiffness. In a study of vertical jumping and landing, Lees (1981) reported maximum vertical impact forces for "hard" and "soft" landing styles of approximately 3.5 and 2 times body weight, respectively.

Very few studies have been conducted to examine impact forces on military parachutists landing from a jump. In a study for the Navy, Reid, Doerr, Doshier, and Ellerston (1971) used linear accelerometers on parachutists to measure the g forces of opening shock and landing. The average $+g_z$ (acceleration in the vertical direction) reported for landings was 7.9 with a range from 3.2 to 17.0. The average $\pm g_x$ (acceleration in the horizontal direction-forward and backward) for landings was 5.8 with a range from 2.0 to 13.0. Unlike most Army parachutists, the parachutists in this study did not perform PLFs when they landed.

In a study carried out by Johanson and Wittendorfer (1985), a parachutist was instrumented with triaxial accelerometers. They reported significant differences between parachute landing falls versus stand up landings, landings in sand versus landings on concrete, landings from 0.61 m (2 ft) platforms versus 1.22 m (4 ft) platforms, and accelerations measured at the thigh versus accelerations measured at the shin.

Unpublished studies by Stannard, Harris, Ward and Bucknell (1991a, 1991b) examine energy absorption during PLFs from a 1.91 m (6.25 ft) high platform. In both studies, pressure sensitive film was used to collect information on pressure distribution over the soles of the feet. Their results show experience has an effect on energy absorption, footgear has an effect on forefoot and heel pressure, and landing position (left or right, front side, or rear) has no effect on energy absorption.

The prior art does not disclose or suggest a lightweight, collapsible impact-absorbing device that may be quickly donned and doffed and is specifically designed to attenuate or dissipate the impact forces paratroopers receive when they land on the ground.

SUMMARY OF THE INVENTION

The Human Research and Engineering Directorate (HRED) of the Army Research Laboratory conducted studies to determine exactly what forces and moments are generated and used this data to develop and design the present invention. Testing of the impact absorbing system has validated its effectiveness in reducing the landing impacts and forces transmitted to the parachutist.

The Human Research and Engineering Directorate (HRED) conducted a two part study entitled "Lower Extremity Assistance For Parachutist (LEAP) Program: Quantification Of The Biomechanics Of The Parachute Landing Fall And Implications For A Device To Prevent Injuries." This study was done to quantify the forces and impacts a parachutist receives when he impacts the ground and performs the Parachute Landing Fall (PLF) technique. Subjects were videotaped as they jumped from platforms set at three different heights (3.5 ft., 4.5 ft., and 5.6 ft.) and landed on a force plate. In the first part of the study, subjects performed PLFs in one of five legwear conditions. The five legwear conditions were: boots, boots and ankle braces, boots and knee braces, boots with ankle and knee braces, or boots with a viscoelastic material covering the force plate. Data and information from the first part of this study was used to design the present invention. The second portion of the study tested the efficiency of the present invention in simulated combat parachute jumps.

The development of a device to prevent lower extremity injuries is aimed at increasing the survivability of parachutists. These soldiers risk injury because they often carry more than 45 kg (100 lbs.) of equipment as they parachute, fast rope, or rappel onto unimproved drop zones. The risk of injury is further increased because these missions are often carried out in bad weather and under cover of darkness. The desire for lower altitude, higher speed parachute drops in the future, is another potential factor affecting survivability. Soldiers parachuting from lower altitudes and at higher speeds are likely to land at higher speeds, and the parachutists will probably have less control over their orientation with respect to the ground.

The landing technique taught to parachutists in the Army is the parachute landing fall (PLF). The idea behind the PLF is to reduce impact forces and mitigate injuries by distributing the impact over a large area of the body and increasing the time during which the impact is absorbed. Automobile air bags use this same principle for injury prevention. *Field Manual* 57–220 (Department of the Army and Department of the Air Force, 1984) describes the PLF and the five points of contact the parachutist's body makes with the ground. The sequence for the five points of contact during a PLF requires contacting the ground with I) toes or balls of the feet, II) calf, III) thigh, IV) buttocks, and V) latissimus dorsi muscle.

The instant study examined the biomechanical results as a function of the footwear worn by the paratrooper when landing. Based on the results, there is no significant difference between the impact absorbing soles. When the results of the jumps with the impact absorbing soles are compared to the results for jumps in boots only or jumps with ankle braces, significant differences occurred. There are, for a small number of measures, exceptions to the previous statements.

The most important results of the study are the significant decreases in impact forces and moments recorded for jumps with the impact absorbing soles when compared to jumps in boots only or jumps with the ankle brace used in the first study. These decreases occur because the impact absorbing soles act increase the time over which the impact is absorbed.

With the impact absorbing soles a jump from 1.71 m (5.6 ft) feels like a boots only jump from 1.37 m (4.5 ft) or lower. In other words, a landing with the impact absorbing soles at a descent rate of 5.79 m/s (19 ft/s) feels like a landing from a boots only jump at a lower descent rate such as 5.18 m/s (17 ft/s) or less.

Wearing impact absorbing soles should result in fewer injuries because injury rate is a function of descent rate (Pirson & Verbiest, 1985), and the impact absorbing soles make the apparent descent rate lower. The values for peak vertical and horizontal forces are not significantly different among the various materials used in the impact absorbing soles. Although, at the higher height, EVA soles have the lowest maximum vertical force and AKTON (a viscoelastic polyurethane polymer, trademark of Action Products, Inc., Hagerstown, Md.) soles have the lowest maximum horizontal force. This is a result of the response of the materials to the forces in these directions.

In view of the foregoing, a primary object of the invention is to provide a lightweight, collapsible impact-absorbing device that may be quickly donned and doffed and is specifically designed to attenuate or dissipate the impact forces paratroopers receive when they land on the ground.

According to the invention an impact absorbing device for parachutists is described. A conventional overshoe may be modified by riveting or otherwise fastening hook and loop material to the bottom of the overshoe. An impact absorbing sole having a top surface including hook and loop material may be quickly attached to and detached from the modified overshoe.

It is also contemplated to provide fastening straps in lieu of or in addition to the hook and loop fastener. The fastening straps may encircle the forefoot area and/or the heel and ankle. The sole may have three layers of solid material or the middle layer may include apertures, which correspond to the heel and ball areas of the foot, for receiving cushioning inserts. The layers may be made of a high density open cell urethane foam, a microcellular ethylene vinyl acetate (EVA) polyethylene foam, a viscoelastic plasticized polyurethane polymer, or a viscoelastic urethane rubber polymer. The layers may be laminated together using any conventional adhesive.

BRIEF DESCRIPTION OF THE DRAWINGS

FIG. 18 shows a chart of material properties for certain impact absorbing materials.

DETAILED DESCRIPTION OF THE PREFERRED EMBODIMENTS

The impact absorbing soles according to the present invention were conceived to enhance the abilities of parachutists to perform their missions by attenuating or eliminating the impact forces a parachutist is subjected to upon making contact with the ground during the PLF. The description below is for both the Impact Absorbing Soles (IAS) and the Impact Absorbing Soles with Inserts (IASI).

Any parachutist may quickly attach and detach the IASI with little or no modifications to their existing equipment and jump systems. The IASI are easily and quickly attached to the parachutist and do not interfere with any of their current clothing or equipment. After impact, the IASI are easily removed from the feet allowing the parachutist to assume his role as a ground combatant.

Figure 1:
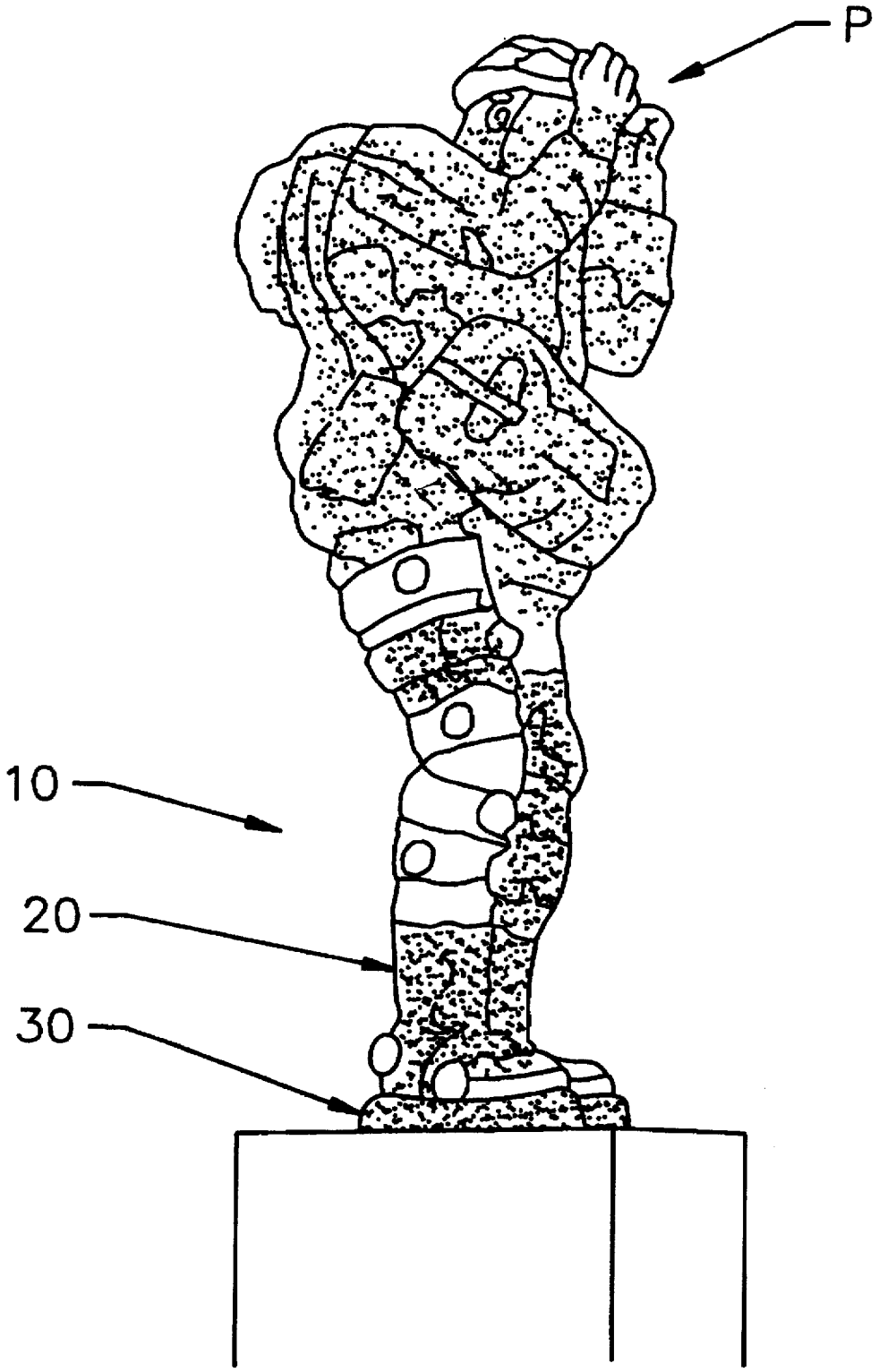
FIG. 1 shows a perspective view of a military parachutist wearing overshoes and impact absorbing soles according to the present invention.

FIG. 1 shows a military parachutist P wearing a protective helmet, load bearing equipment and the impact-absorbing device 10. According to the preferred embodiment, a pair of modified vinyl overshoes 20 and impact-absorbing soles 30 form the impact-absorbing device.

Figure 2:
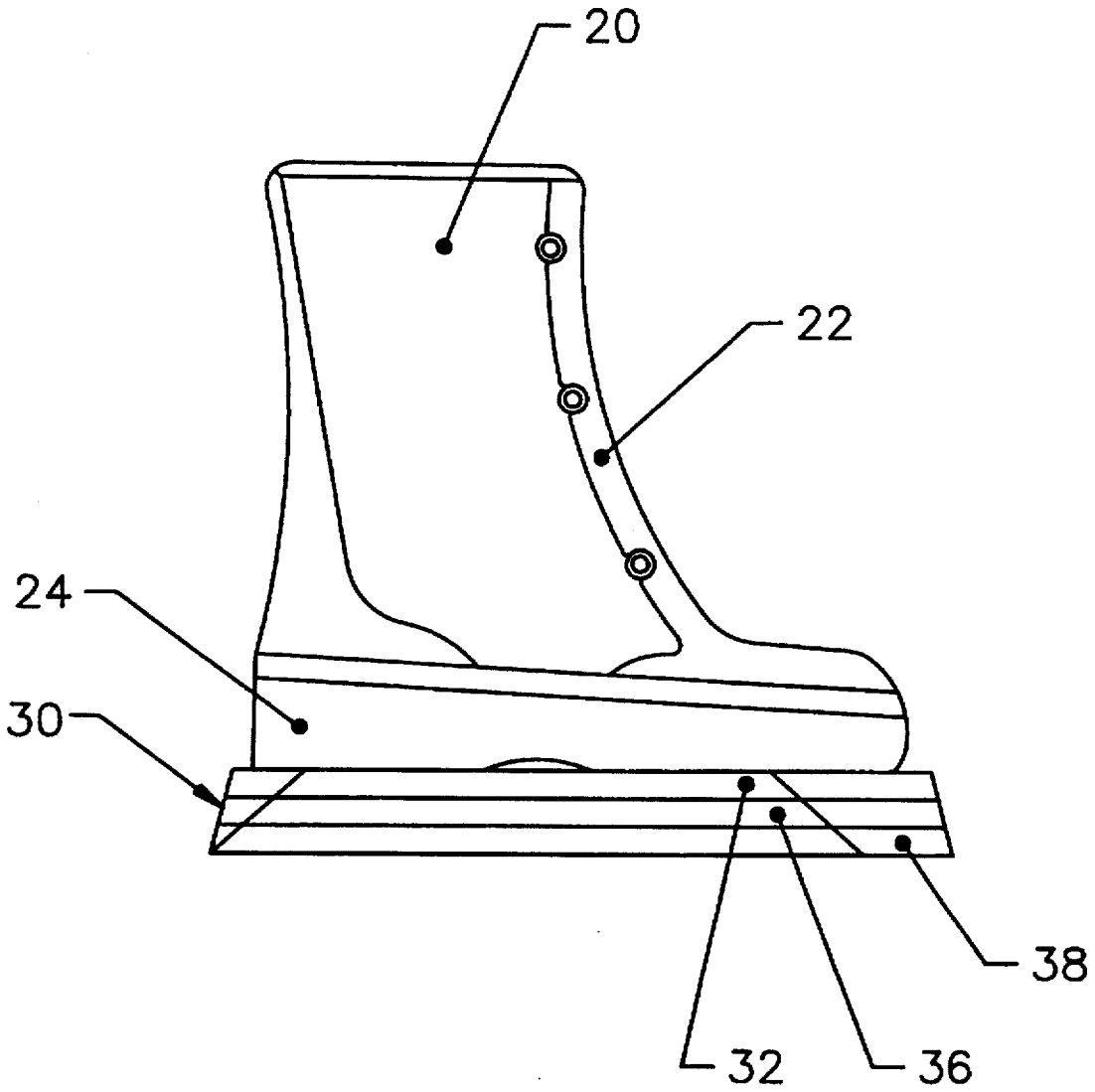
FIG. 2 shows a side elevation view of a modified overshoe and an impact absorbing sole according to the present invention attached thereto.
Figure 3:
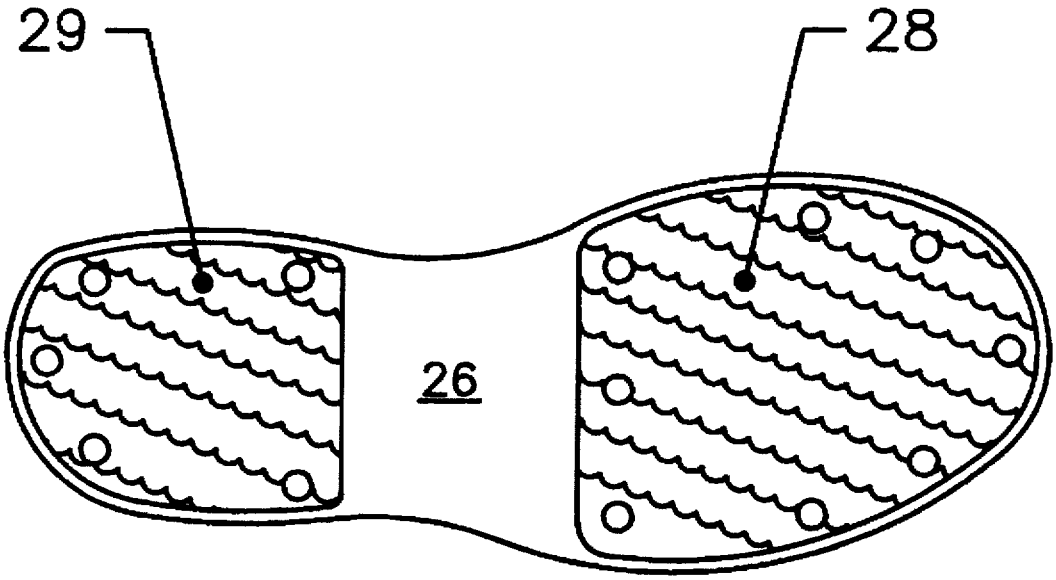
FIG. 3 shows a bottom plan view of the modified overshoe with hook (or loop) fastener material on the overshoe.

FIGS. 2 and 3 show an overshoe 20 including an upper 22 and a sole 24 connected to a first embodiment 30 of an impact-absorbing sole. A bottom 26 of the sole may have a first area 28 of hook or loop material that corresponds to the ball area of the foot and a second area 29 of hook or loop material that corresponds to the heel area of the foot. The sole has a multi-layer construction and preferably has three layers: a first or upper layer 32, a second or middle layer 36 and a third or bottom layer 38.

Figure 4:
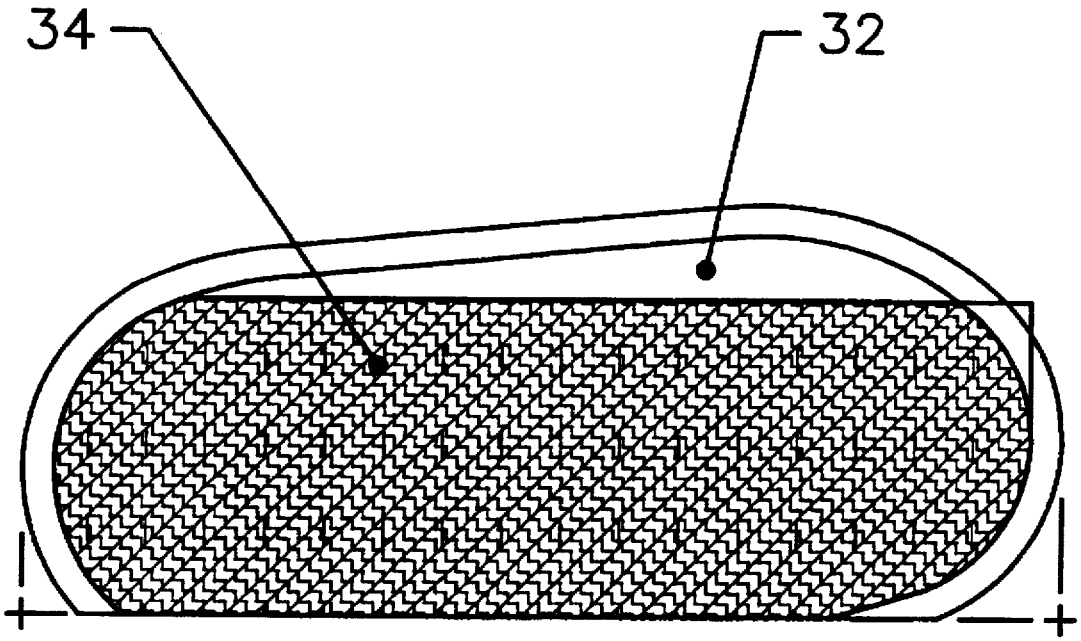
FIG. 4 shows a top plan view of an impact absorbing sole with hook (or loop material) located thereon according to the present invention.
Figure 5:
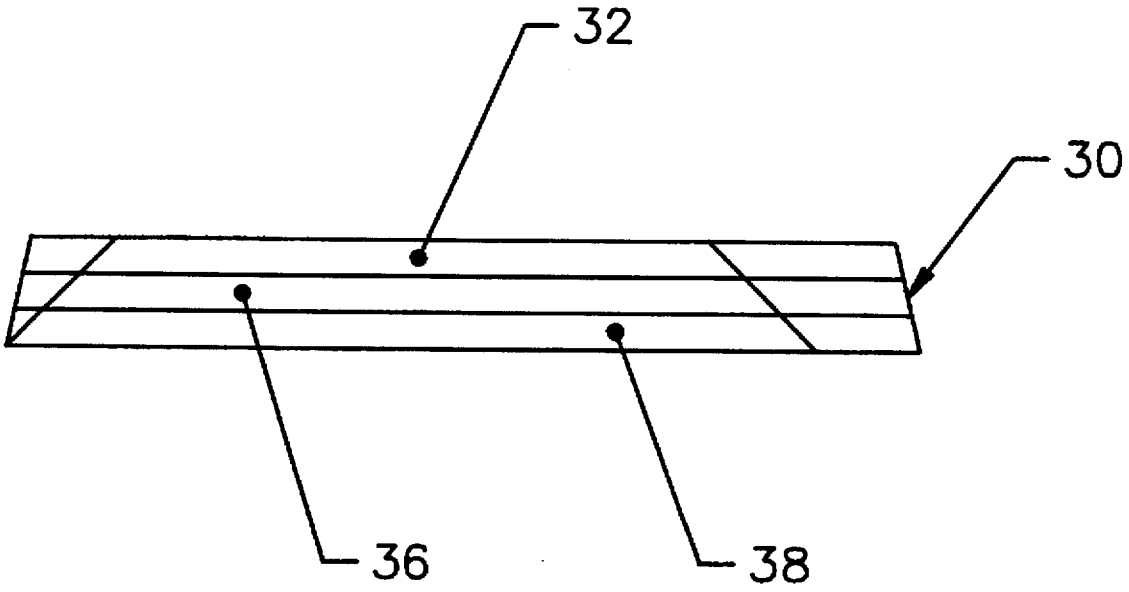
FIG. 5 shows a side elevation view of the impact absorbing sole of FIG. 4.
Figure 6:
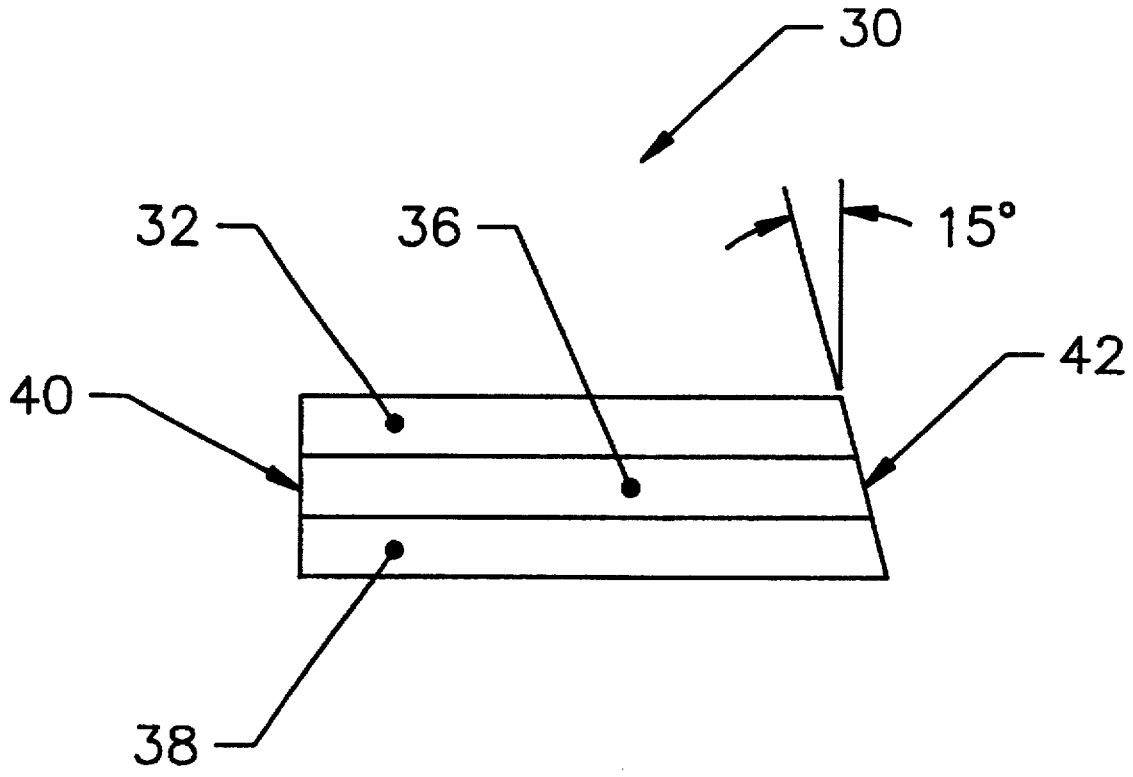
FIG. 6 shows a front end view of the impact absorbing sole of FIG. 4.
Figure 7:
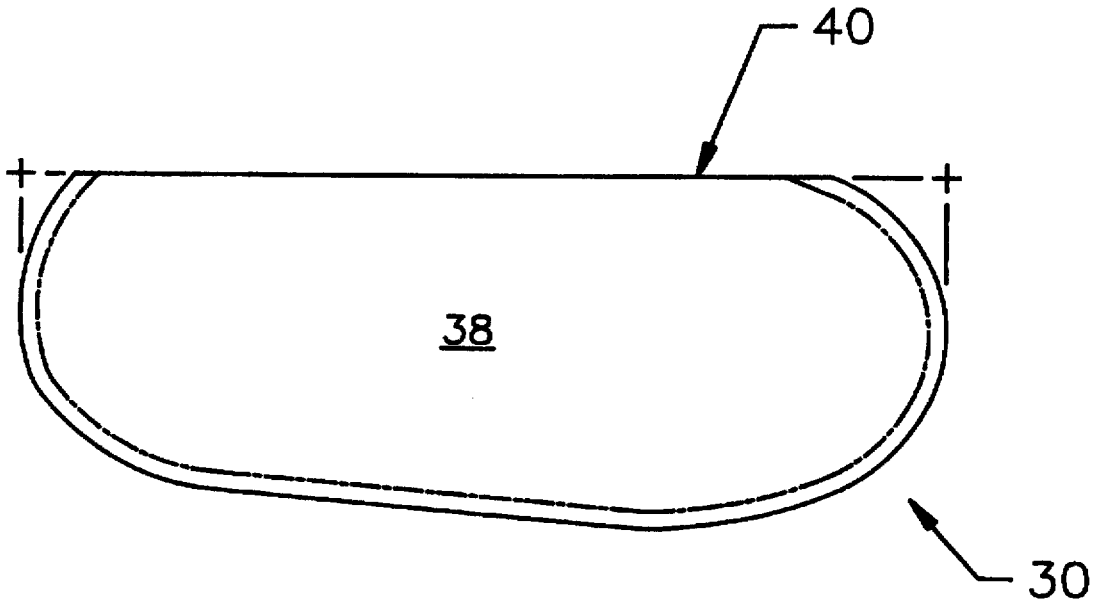
FIG. 7 shows a bottom plan view of the impact absorbing sole of FIG. 4.
Figure 8:
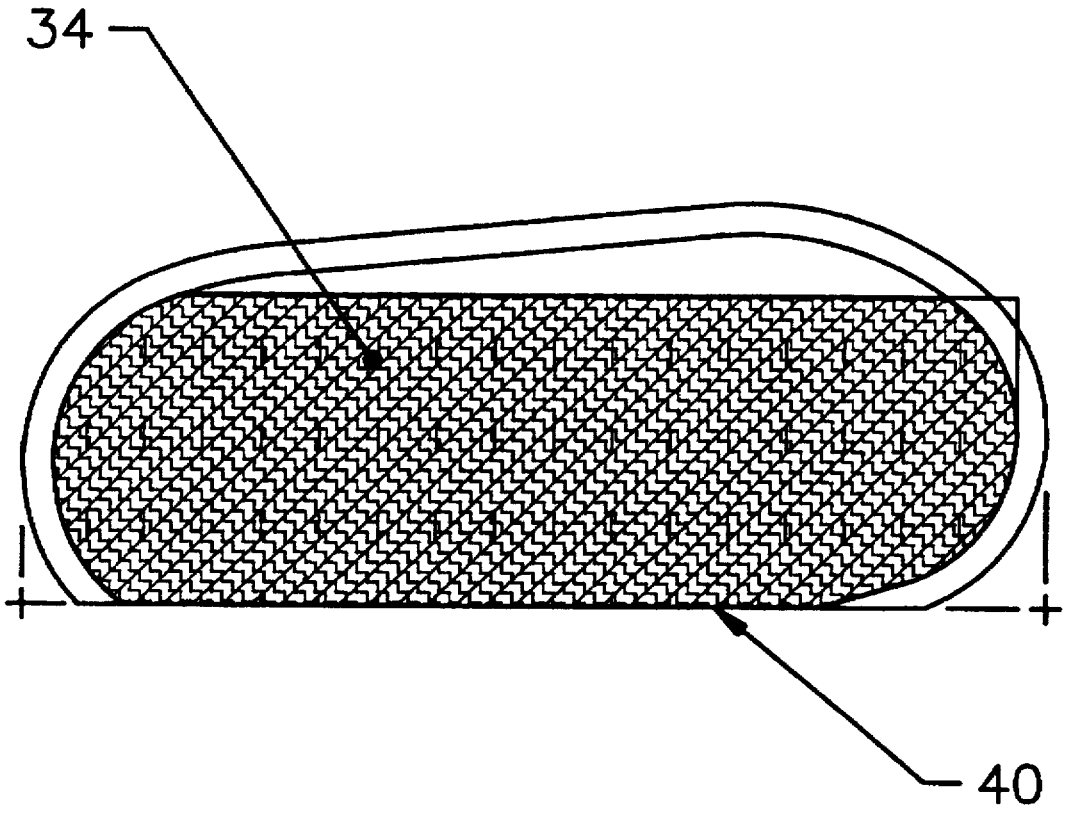
FIG. 8 shows a top plan view of the impact absorbing sole with hook (or loop material) located thereon according to a second embodiment of the present invention.
Figure 9:
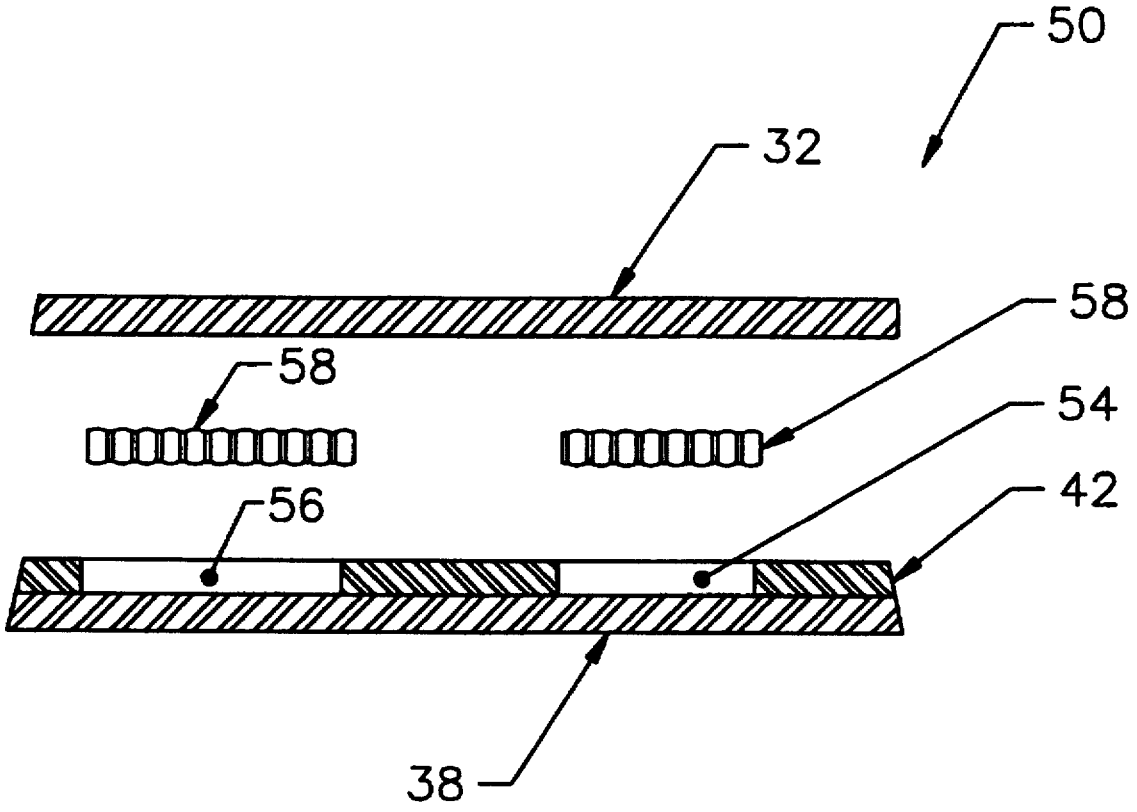
FIG. 9 shows an exploded side elevation view of the impact absorbing sole of FIG. 8.
Figure 10:
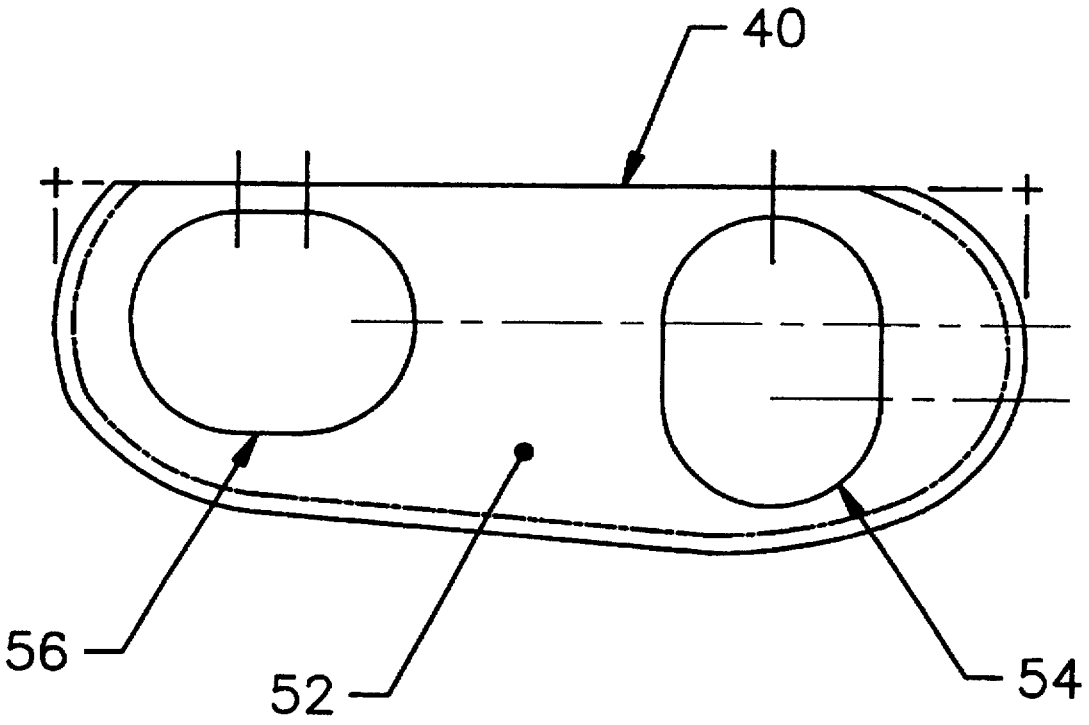
FIG. 10 shows a bottom plan view of a middle layer of the impact absorbing sole of FIG. 8.
Figure 11:
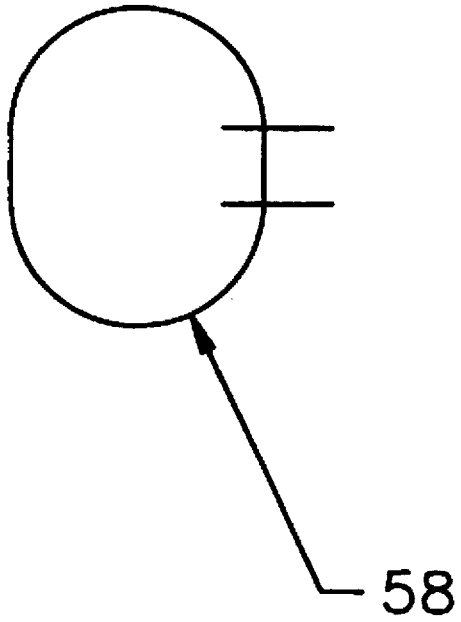
FIG. 11 shows a plan view of a cushioning insert sized to fit within one of the apertures of the middle layer of the impact absorbing sole of FIG. 8.

FIGS. 4–7 show the first embodiment 30 of the impact-absorbing soles in detail. For the sake of convenience only the left sole is shown, as the right sole is a mirror image of the left sole. Hook or loop material 34 is placed along the top of first layer 32. As best shown in FIGS. 4 and 6, the majority of the periphery of the sole exhibits a tapered edge 42. According to the preferred embodiment the taper is approximately 15°. A portion of the periphery exhibits a flat edge 40 that defines a medial side flat plane. This straight vertical plane cut on the sole allows the feet to be held together for the PLF.

FIGS. 8–11 show a second embodiment 50 of the impact-absorbing soles in detail. Again for the sake of convenience only the left sole is shown, as the right sole is a mirror image of the left sole. Hook or loop material 34 is placed along the top of first layer 32. As shown in 8–10 the majority of the periphery of the sole exhibits a tapered edge 42. According to the preferred embodiment the taper is approximately 15°. A portion of the periphery exhibits a flat edge 40. Middle layer 52 includes a first aperture 54 that corresponds to the location of the ball of the foot and a second aperture 56 that corresponds to the location of the heel of the foot. Inserts 58 of energy absorbing materials may be placed in apertures 54, 56. These inserts are placed in the ball of the foot and heel regions for maximum energy absorption. This embodiment is designed to absorb greater impact forces that the first embodiment.

The overshoe has one of hook and loop material and the sole has the other of hook and loop material to provide a mechanism for quickly attaching and detaching the sole and the overshoe. The overshoe also provides a quick and secure attachment and detachment mechanism with respect to a parachutist's jump boot.

Figure 12:
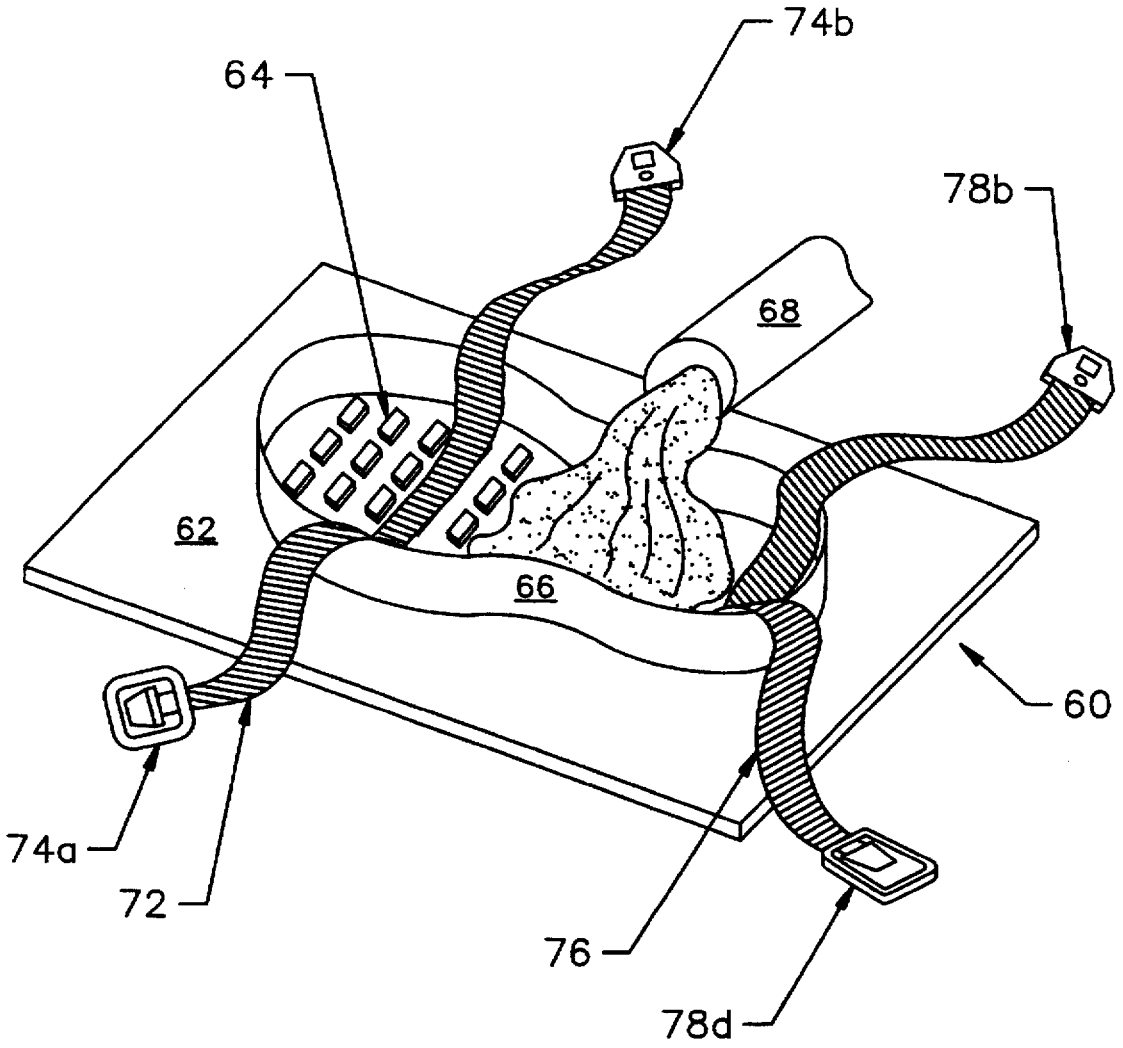
FIG. 12 shows a perspective view of a molding process for an impact absorbing sole according to the present invention.

FIG. 12 shows another alternate embodiment of a sole. A liquid mold material may exit a material port 68 and enter an open mold 60. The mold may include a mold bottom 62 having a predetermined tread pattern 64 located therein. Integral straps may be placed in the mold so resulting sole has the straps fixedly attached thereto. According to the preferred embodiment the straps include a forefoot strap 72 having flexible male and female connectors **74*a*, 74*b* and a heel/ankle strap 76 having flexible male and female connectors 78*a*, 78*b***. After the mold material solidifies a layer of hook or loop material may be applied to the top surface thereof for connection to the hook or loop material on the overshoe. According to this embodiment one or two fastening mechanisms may be present: a hook and loop fastener and/or forefoot and/or heel/ankle straps.

Figure 13:
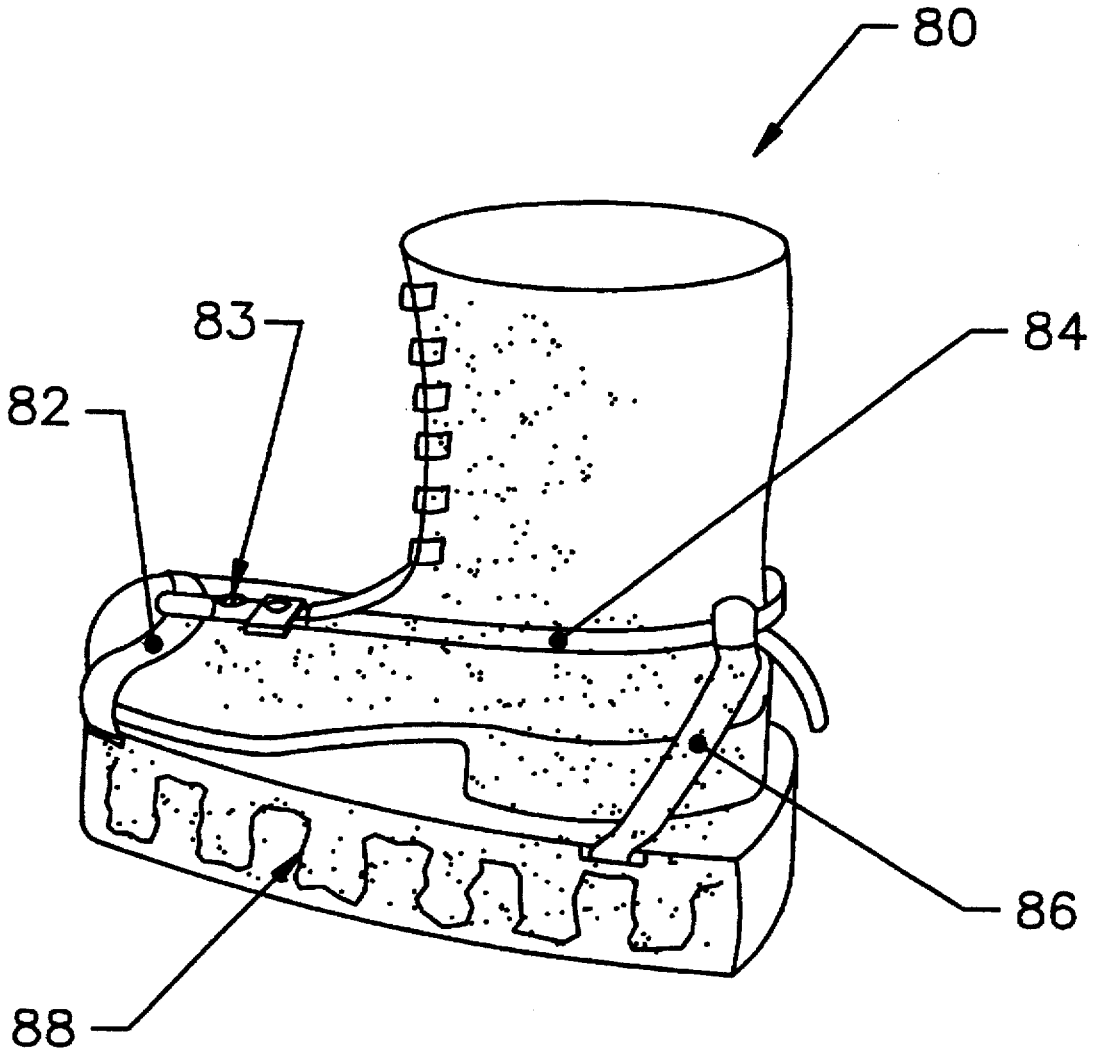
FIG. 13 shows a perspective view of an impact absorbing sole with fastening straps according to the present invention.
Figure 14:
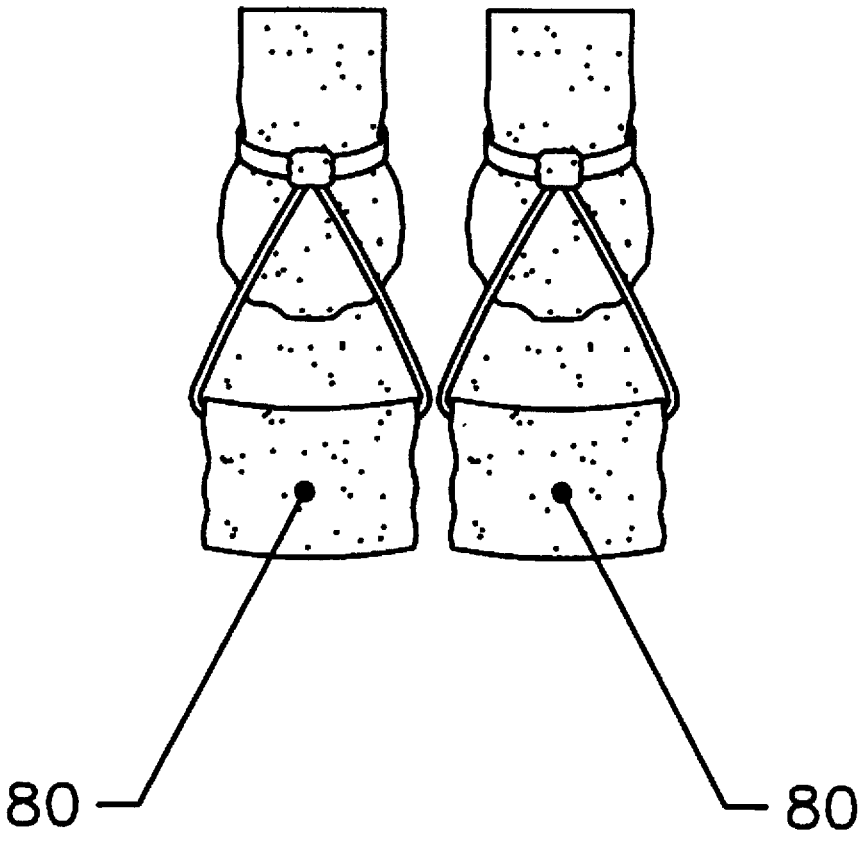
FIG. 14 shows a side elevation view of the impact absorbing sole of FIG. 13.

FIGS. 13 and 14 show another alternate embodiment 80 of a sole. Each sole has hook or loop material attached along flat edge so the soles may be held together in a PLF by both the parachutist and the hook and loop fastener. Toe straps 82 and heel straps 86 may be connected to the sole. A single button quick release buckle with a length or size adjustment feature is located on ankle straps 84, which are located between the toe straps and the heel straps. A layer of hook or loop material may be applied to the top surface of the sole for connection to the hook or loop material on the overshoe. According to this embodiment one or two fastening mechanisms are be present: a hook and loop fastener and/or straps with a button release.

Figure 15:
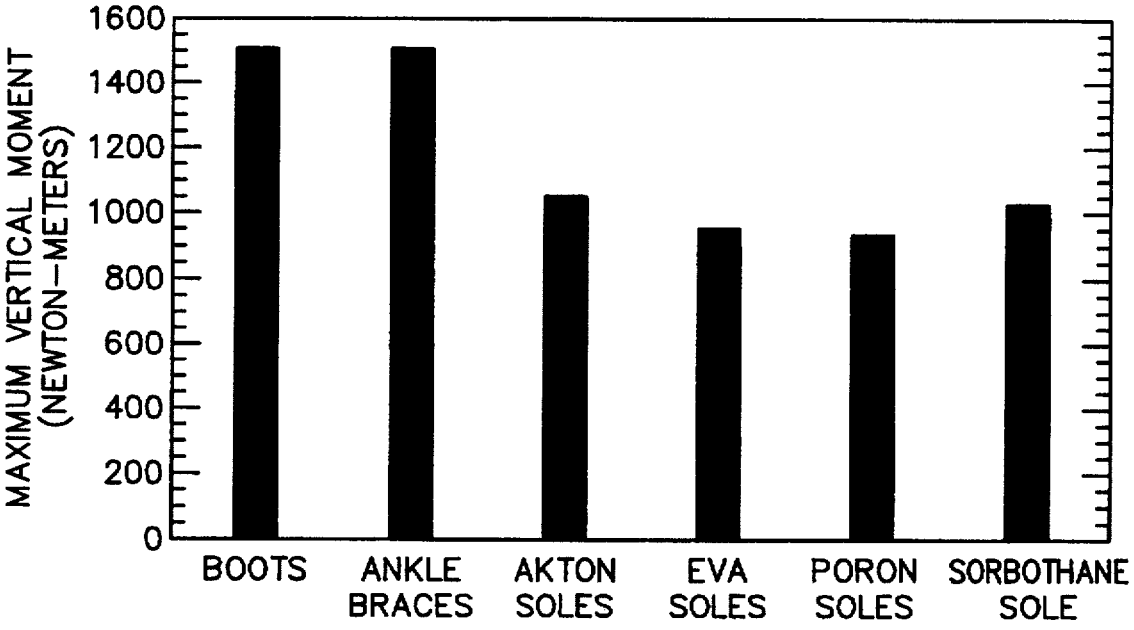
FIG. 15 shows a bar chart of maximum vertical moment about the vertical axis by legwear.
Figure 16:
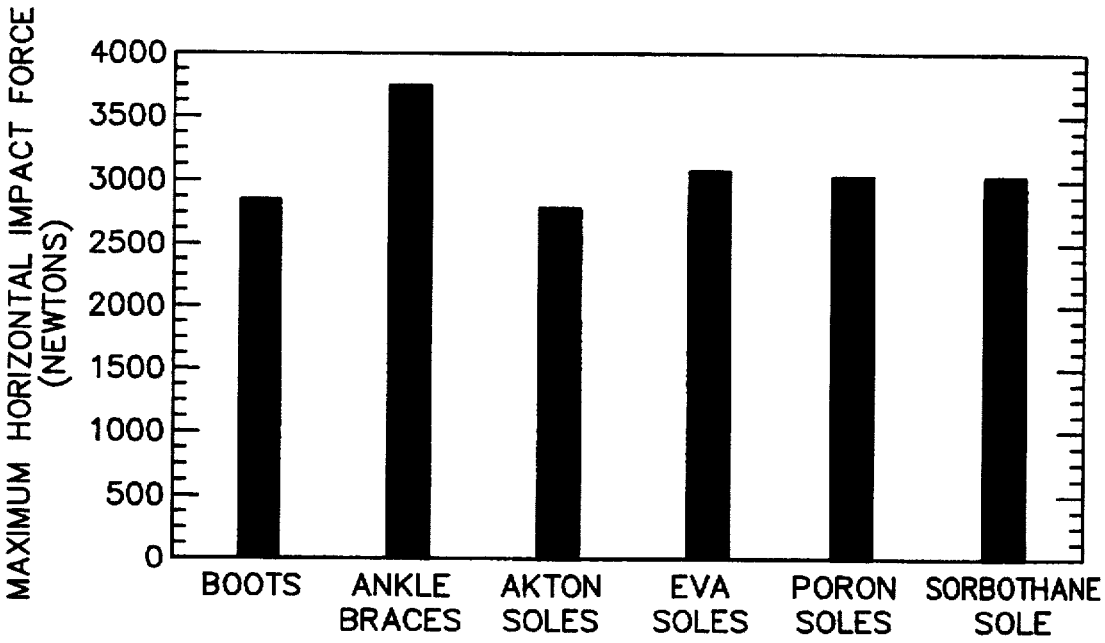
FIG. 16 shows a bar chart of maximum horizontal impact force by legwear.
Figure 17:
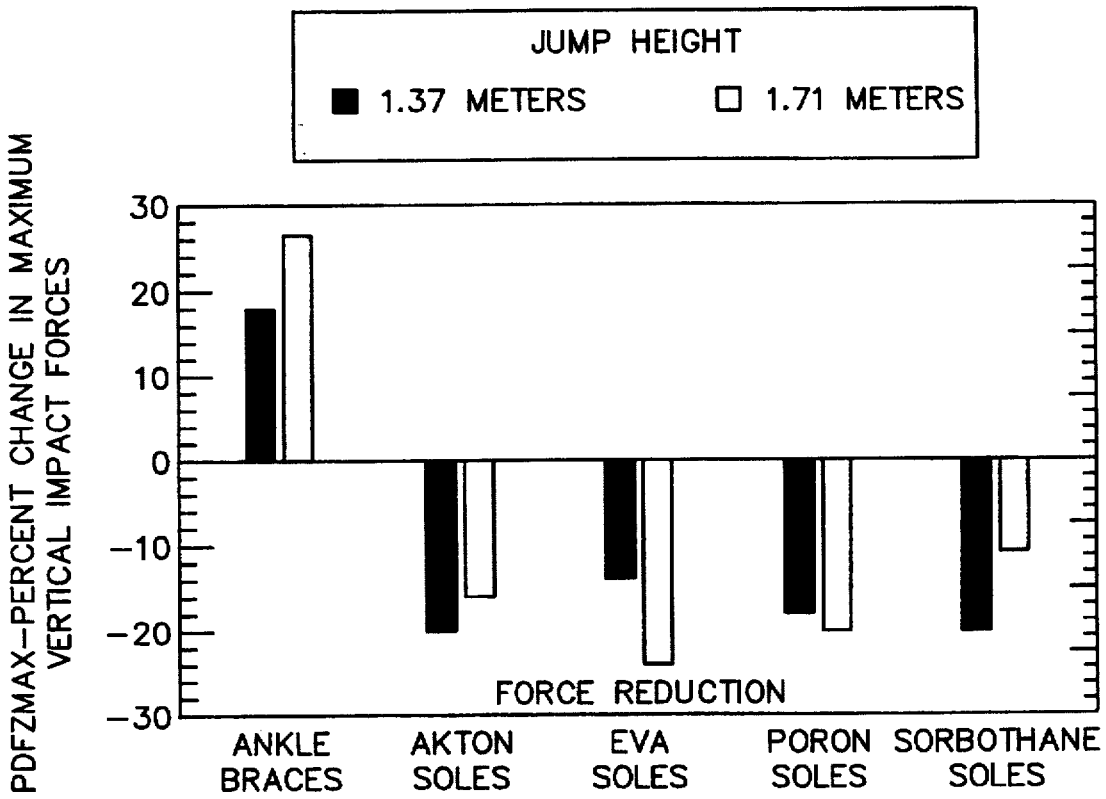
FIG. 17 shows a bar chart of percent changes in maximum vertical impact versus legwear by jump height.

FIGS. 15–17 show bar charts that compare impact forces for the various legwear conditions. FIG. 15 shows a bar chart of maximum vertical moment about the vertical axis by legwear. FIG. 16 shows a bar chart of maximum horizontal impact force by legwear. FIG. 17 shows a bar chart of percent changes in maximum vertical impact versus legwear by jump height.

FIG. 18 shows a chart of material properties for certain impact absorbing materials. The superior hardness values for SORBOTHANE (a viscoelastic plasticized polyurethane polymer, trademark of Sorbothane, Inc., Kent Ohio) and AKTON are accompanied by unacceptably high weights for soles constructed entirely of those materials. The preferred embodiments are 1) a sole having PORON (a high density open-cell urethane foam produced by the Rogers Corporation of East Woodstock, Conn.) and EVA layers, 2) a sole have only PORON layers or a sole have PORON layers and one or both inserts of SORBOTHANE or AKTON.

In use the invention is simple and functions in the following sequence:

First, the impact-absorbing sole is constructed by laminating the layers together and in the case of the model with inserts, the inserts are placed into the pockets of the middle layer before the layers are laminated. The medial side (inside of the foot) of the IASI, is cut straight and parallel with the mid sagittal plane (the vertical plane which divides the body into right and left halves), which allows the two feet to be drawn together in contact with each other. This is the preferred position for a proper PLF.

Once laminated the IASI has the layer of loop fastener applied to the top layer of the energy attenuating material. The overshoe is prepared for attachment of the hook fastener material and then this material may be applied with adhesive and rivets to provide a very secure yet flexible attachment mechanism.

The parachutist may slide the modified overshoes over the jump boots and attach the impact-absorbing soles to the bottom of the appropriate overshoe. Once the soles are securely attached the parachutist is ready to jump and perform his PLF.

As the parachutist makes contact with the ground, the impact-absorbing device begins to deform and slow the downward descent, thus reducing the impact forces by dissipating the impact energy over a longer period of time. The two inserts allow additional energy absorption capabilities by using a different material and unique properties associated with each particular material.

When the PLF has been completed the parachutist simply kicks off the IASI and performs a predetermined duty assignment. The parachutist can also remove the overshoes at this time or as the mission circumstances will allow.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. An impact absorbing device that may be quickly donned and doffed over a parachutist's shoes comprising:

a left overshoe having an overshoe fastening surface along a bottom thereof, said overshoe fastening surface having one part of a hook and loop material;

a left impact absorbing sole having a multi-layer construction, a first layer of said sole having a sole fastening surface along a top thereof, said sole fastening surface having the other part of said hook and loop material, the medial side of said impact absorbing sole being straight, normal, and parallel with the parachutist' mid sagittal plane and having one part of a hook and loop material attached thereon;

a right overshoe having an overshoe fastening surface along a bottom thereof, said overshoe fastening surface having one part of a hook and loop material;

a right impact absorbing sole having a multi-layer construction, a first layer of said sole having a sole fastening surface along a top thereof, said sole fastening surface having the other part of said hook and loop material, the medial side of said impact absorbing sole being straight, normal, and parallel with the parachutist's mid sagittal plane and having the other part of a hook and loop material attached thereon thereby allowing said parachutist to bring said left and right overshoes in intimate contact with each other and to remain in intimate contact with each other before and during impact with the ground to thereby aid said parachutist in performing a proper parachute landing fall.

2. The impact absorbing device according to claim 1, wherein at least one layer of said sole includes a high density open cell urethane foam.

3. The impact absorbing device according to claim 1, wherein at least one layer of said sole includes a microcellular ethylene vinyl acetate polyethylene foam.

4. The impact absorbing device according to claim 1, wherein at least one layer of said sole includes a viscoelastic plasticized polyurethane polymer.

5. The impact absorbing device according to claim 1, wherein at least one layer of said sole includes a viscoelastic urethane rubber polymer.

6. The impact absorbing device according to claim 1, wherein at least one layer of said sole includes at least one aperture and a cushioning insert located within said aperture.

7. The impact absorbing device according to claim 1, further comprising fastening straps connected to said sole and configured to encircle a portion of said overshoe and fasten said sole to said overshoe.

8. A pair of impact absorbing soles that may be quickly donned and doffed over a parachutist's shoes comprising:

a left sole having a first layer having a sole fastening surface along a top thereof, said sole fastening surface having one part of a hook and loop material;

at least one additional layer attached to said left sole having a first layer, the medial side of said impact absorbing sole being straight, normal, and parallel with the parachutist's mid sagittal plane and having one part of a hook and loop material attached thereon;

a right sole having a first layer having a sole fastening surface along a top thereof, said sole fastening surface having one part of a hook and loop material;

at least one additional layer attached to said right sole having a first layer, the medial side of said impact absorbing sole being straight, normal, and parallel with the parachutist's mid sagittal plane and having the other part of a hook and loop material attached thereon thereby allowing said parachutist to bring said pair of impact absorbing soles in intimate contact with each other and to remain in intimate contact with each other before and during impact with the ground to thereby aid said parachutist in performing a proper parachute landing fall.

9. The impact absorbing sole according to claim 8, wherein at least one layer of said sole includes a high density open cell urethane foam.

10. The impact absorbing sole according to claim 8, wherein at least one layer of said sole includes a microcellular ethylene vinyl acetate polyethylene foam.

11. The impact absorbing sole according to claim 8, wherein at least one layer of said sole includes a viscoelastic plasticized polyurethane polymer.

12. The impact absorbing sole according to claim 8, wherein at least one layer of said sole includes a viscoelastic urethane rubber polymer.

13. The impact absorbing sole according to claim 8, wherein at least one layer of said sole includes at least one aperture and a cushioning insert located within said aperture.

14. The impact absorbing sole according to claim 8, further comprising fastening straps connected to said sole and configured to encircle a portion of an overshoe and fasten said sole to the overshoe.

* * * * *